US007856687B2

(12) United States Patent
Chou

(10) Patent No.: US 7,856,687 B2
(45) Date of Patent: Dec. 28, 2010

(54) ADJUSTABLE PILLOW DEVICE

(76) Inventor: Hung-Chien Chou, 12F., No. 1000-19, Yongchun E. Rd., Nantun District, Taichung (TW)

( * ) Notice: Subject to any disclaimer, the term of this patent is extended or adjusted under 35 U.S.C. 154(b) by 0 days.

(21) Appl. No.: 12/433,444

(22) Filed: Apr. 30, 2009

(65) Prior Publication Data

US 2009/0276960 A1 Nov. 12, 2009

(30) Foreign Application Priority Data

May 7, 2008 (TW) ..... 97116787 A

(51) Int. Cl.
*A47G 9/10* (2006.01)

(52) U.S. Cl. ..... 5/640; 5/636

(58) Field of Classification Search ..... 5/640, 5/636, 643, 645, 657, 652, 634
See application file for complete search history.

(56) References Cited

U.S. PATENT DOCUMENTS

| | | | | |
|---|---|---|---|---|
| 120,498 | A * | 10/1871 | Couch | 5/634 |
| 5,983,427 | A * | 11/1999 | Igei | 5/643 |
| 6,349,438 | B1 * | 2/2002 | Coleman et al. | 5/648 |
| 2009/0276960 | A1 * | 11/2009 | Chou | 5/640 |

* cited by examiner

*Primary Examiner*—Robert G Santos

(57) ABSTRACT

An adjustable pillow device includes a base adapted to be disposed on a supporting surface, a pillow unit disposed above the base and movable vertically relative to the base, and an adjustable supporting unit mounted on the base, disposed between the base and the pillow unit and operable so as to support the pillow unit in a desired state.

11 Claims, 10 Drawing Sheets

ADJUSTABLE PILLOW DEVICE

CROSS-REFERENCE TO RELATED APPLICATION

This application claims priority of Taiwanese Application No. 097116787, filed on May 7, 2008.

BACKGROUND OF THE INVENTION

1. Field of the Invention

The invention relates to a pillow, more particularly to an adjustable pillow device.

2. Description of the Related Art

A conventional pillow includes a hollow body that is configured with a plurality of chambers, each of which is received with a plurality of inflatable air bags therein and is filled with liquid therein. Hardness and thickness of the conventional pillow can be adjusted through change of amounts of air in the airbags. However, shapes of the air bags are not fixed, and the air bags cannot be effectively positioned in the chambers during use. Therefore, the conventional pillow cannot provide stable support. Furthermore, frequent change of the amounts of air in the air bags is inconvenient during use.

FIG. 1 illustrates another conventional pillow 2 that includes a plurality of base pads 21, and a top pad 22 disposed on the base pads 21. The base pads 21 and the top pad 22 are made of an elastic material. The top pad 22 has a convex portion 221 and a flat portion 222 for supporting respectively the neck and head of a human body thereon. However, a height difference between the flat portion 222 and the convex portion 221 is fixed. Therefore, the conventional pillow 2 cannot accommodate different users. Furthermore, since the base and top pads 21, 22 are elastic, the conventional pillow 2 cannot provide an adequate support for the neck of a human body when the human body lies flat or on its side.

SUMMARY OF THE INVENTION

Therefore, an object of the present invention is to provide an adjustable pillow device that can overcome the aforesaid drawbacks of the prior art.

According to the present invention, a pillow device comprises:

a base adapted to be disposed on a supporting surface;

a pillow unit disposed above the base and movable vertically relative to the base; and an adjustable supporting unit mounted on the base, disposed between the base and the pillow unit, and operable so as to support the pillow unit in a desired state.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
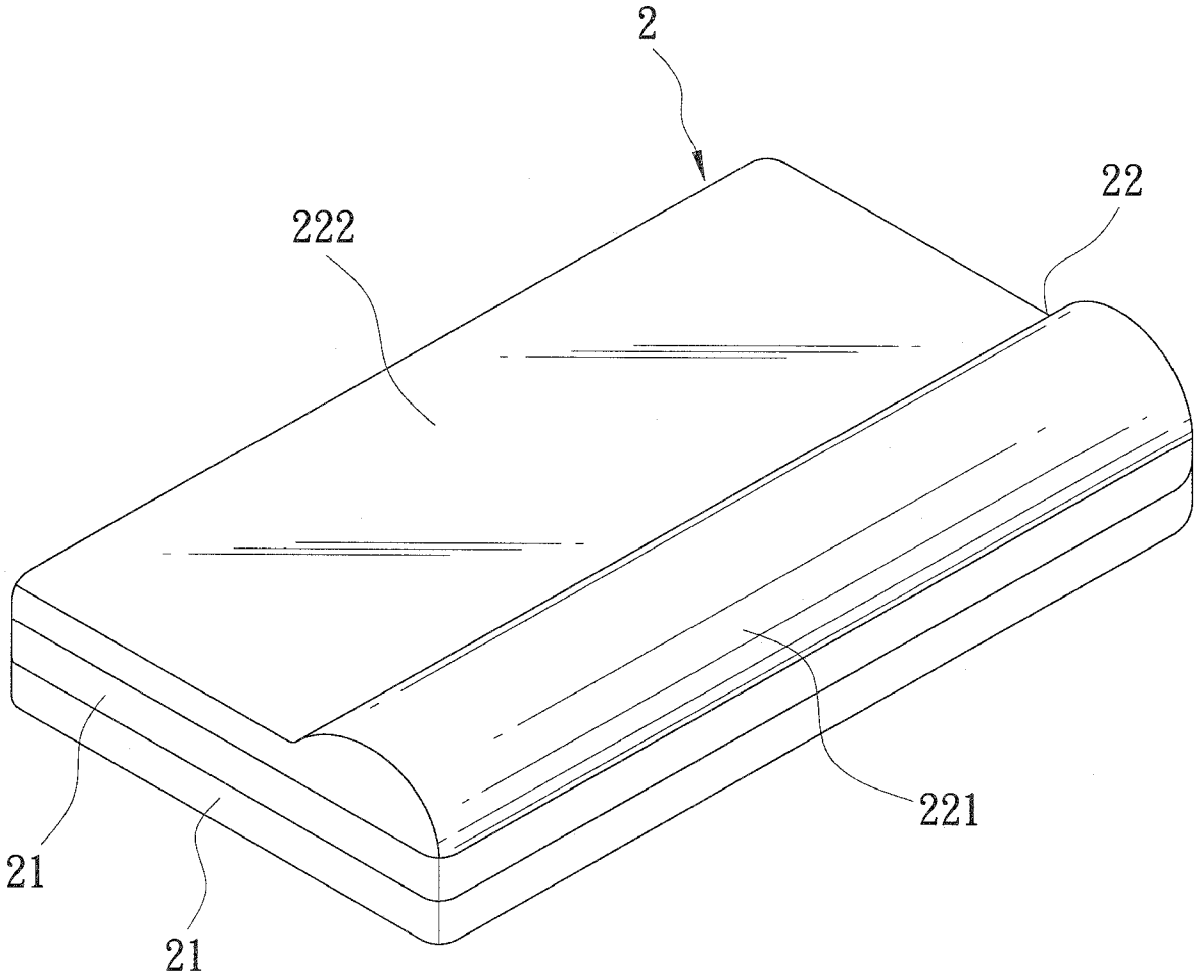
FIG. 1 PRIOR ART
FIG. 1 is a perspective view of a conventional pillow.
Figure 2:
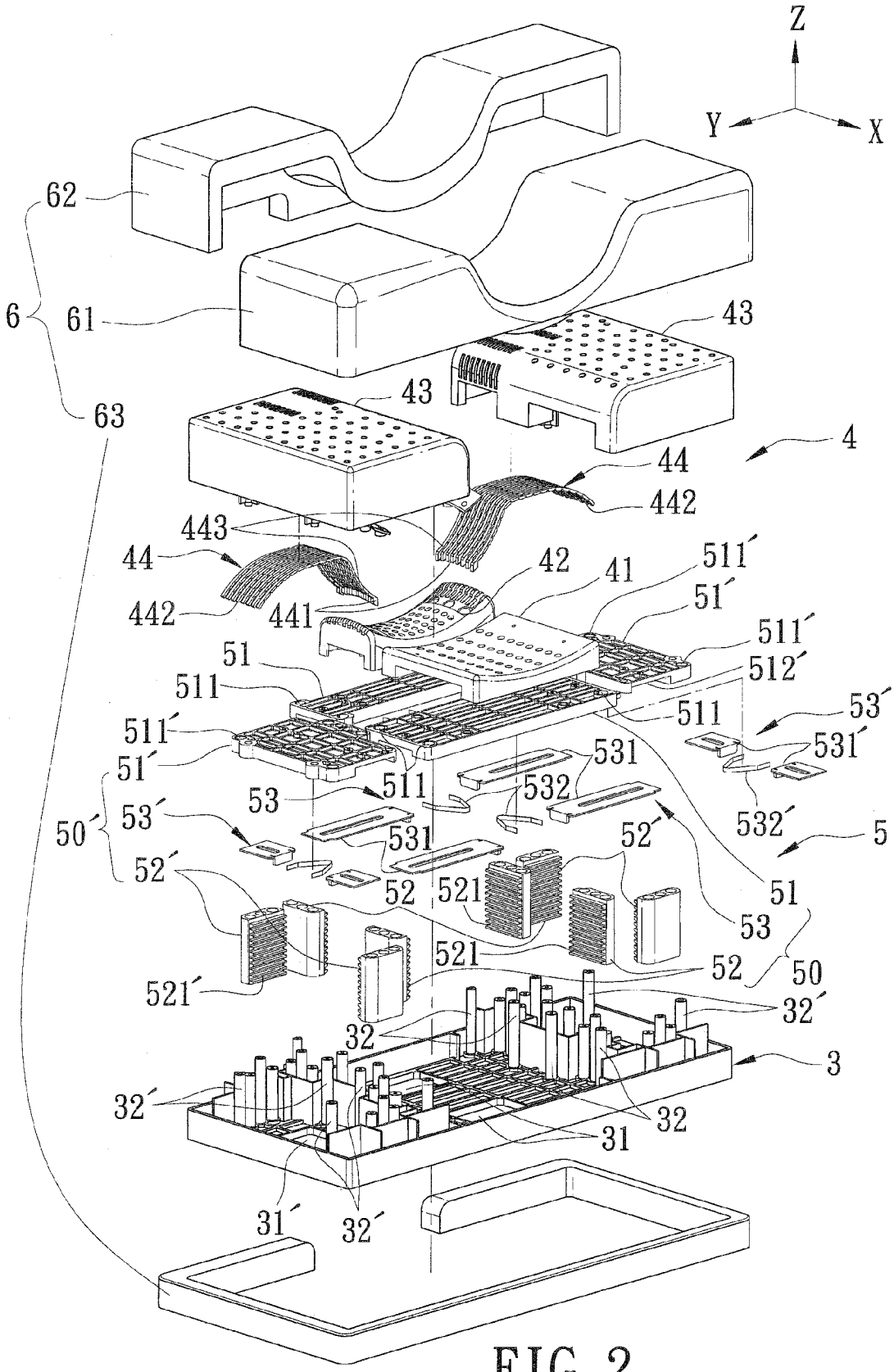
FIG. 2 is an exploded perspective view showing the preferred embodiment of a pillow device according to the present invention.
Figure 3:
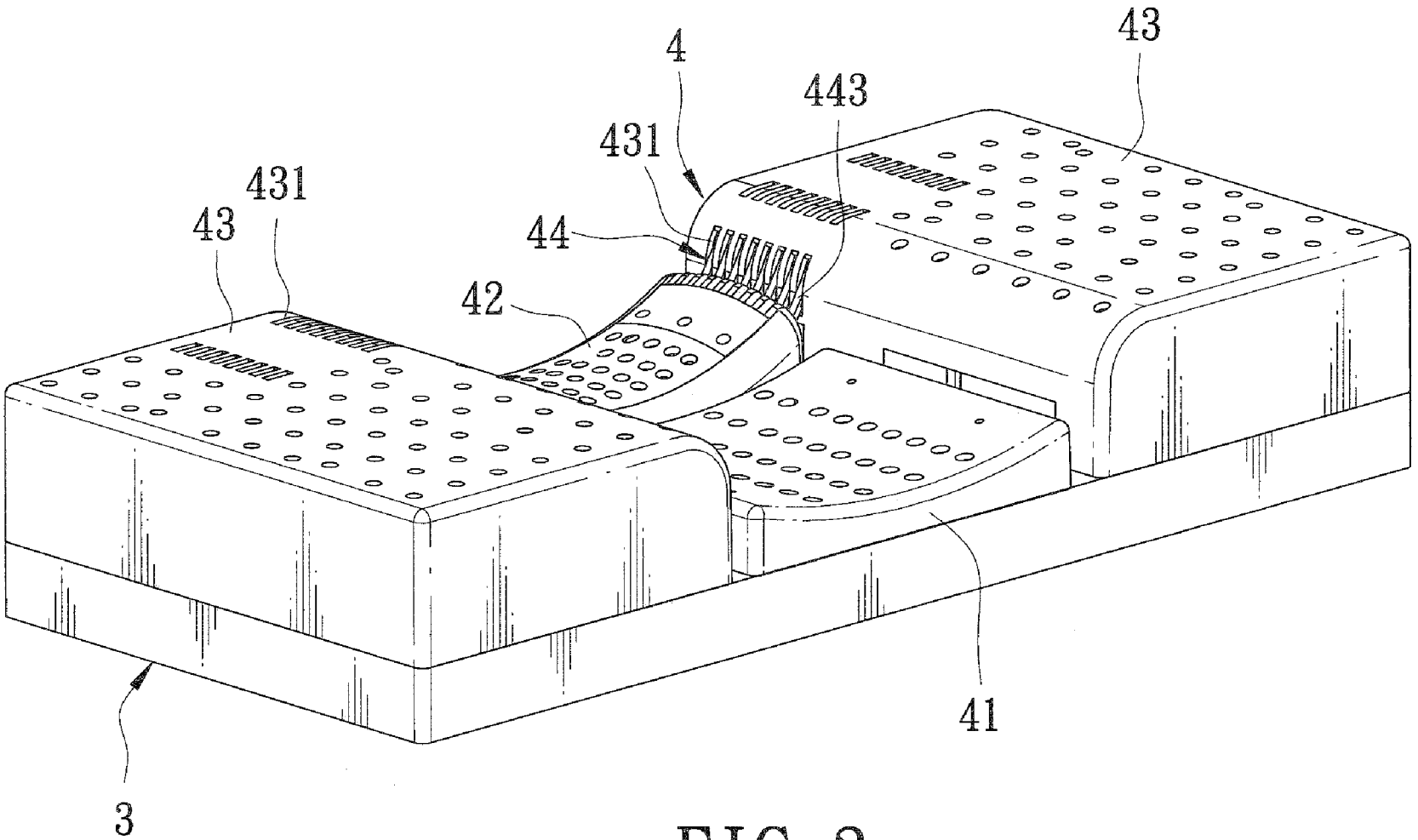
FIG. 3 is a perspective view showing an assembly of a base and a pillow unit of the preferred embodiment.
Figure 4:
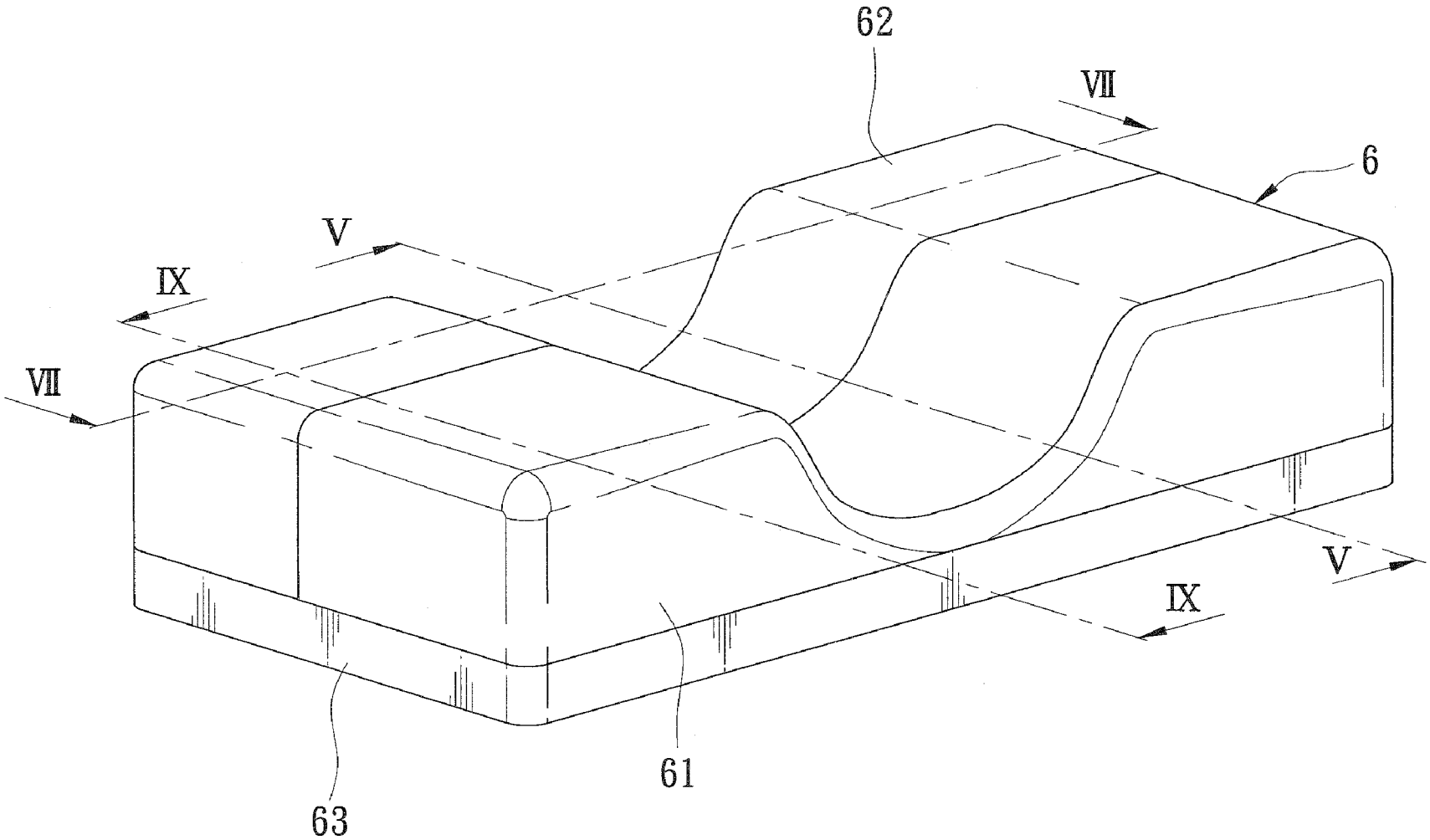
FIG. 4 is a perspective view showing the preferred embodiment.

Referring to FIGS. 2 to 4, the preferred embodiment of a pillow device according to the present invention is shown to include a base 3, a pillow unit 4, an adjustable supporting unit 5, and a cushioning cover 6.

Figure 5:
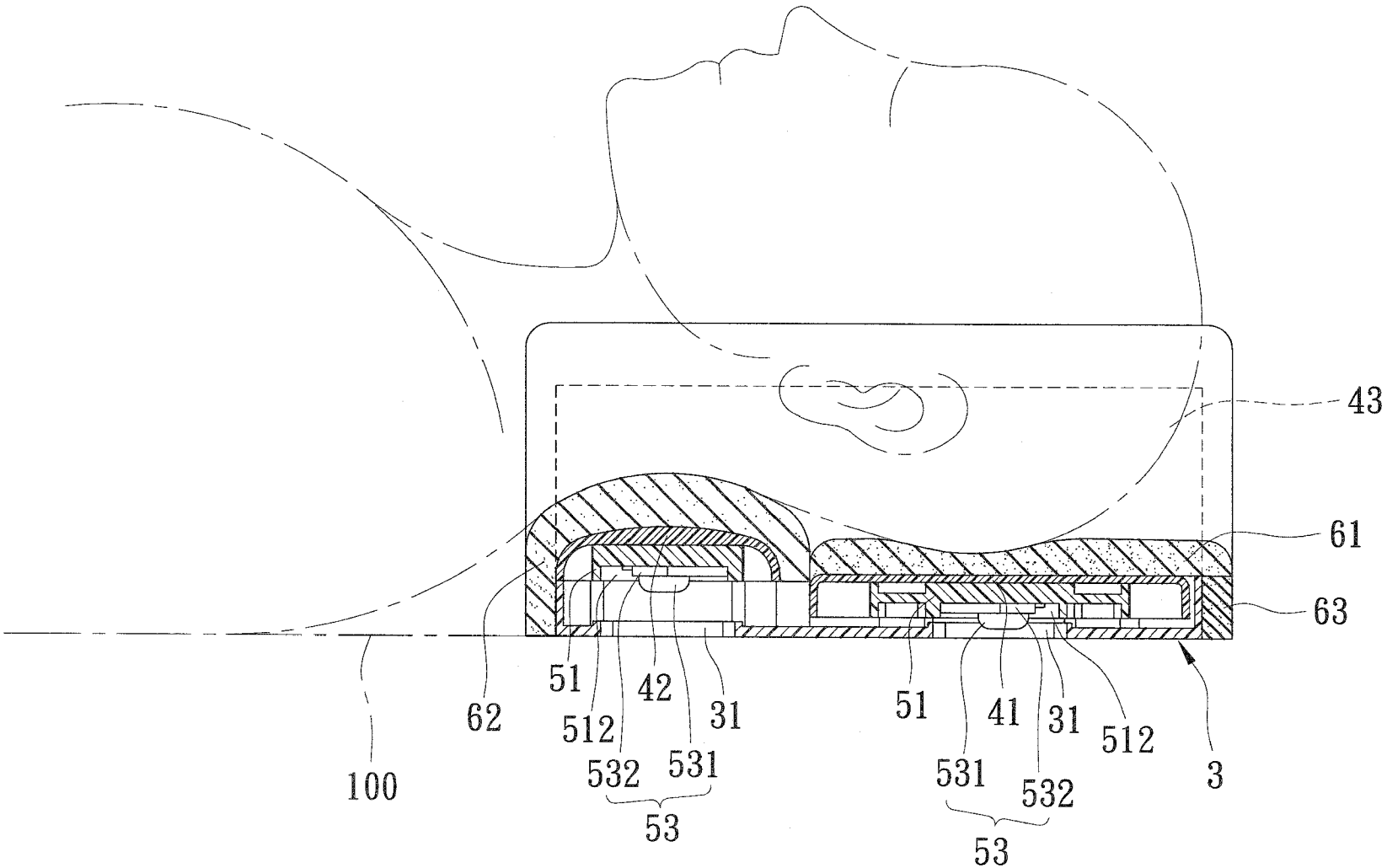
FIG. 5 is a schematic sectional view of the preferred embodiment taken along line V-V in FIG. 4.

The base 3 is rectangular, and is adapted to be disposed on a supporting surface 100 (see FIG. 5). In this embodiment, the base 3 is formed with two first openings 31 aligned with each other in a first direction (X), and two second openings 31' (only one is shown) opposite to each other in a second direction (Y) perpendicular to the first direction (X) such that the first openings 31 are disposed between the second openings 31'. The base 3 is further formed with two first guiding units each having a plurality of extending vertically guiding rods 32 that are disposed around a corresponding one of the first openings 31, and two second guiding units each having a plurality of extending vertically guiding rods 32' that are disposed around a corresponding one of the second openings 31'. That is, the guiding rods 32, 32' extend in a vertical direction (Z) perpendicular to the first and second directions (X, Y).

Figure 6:
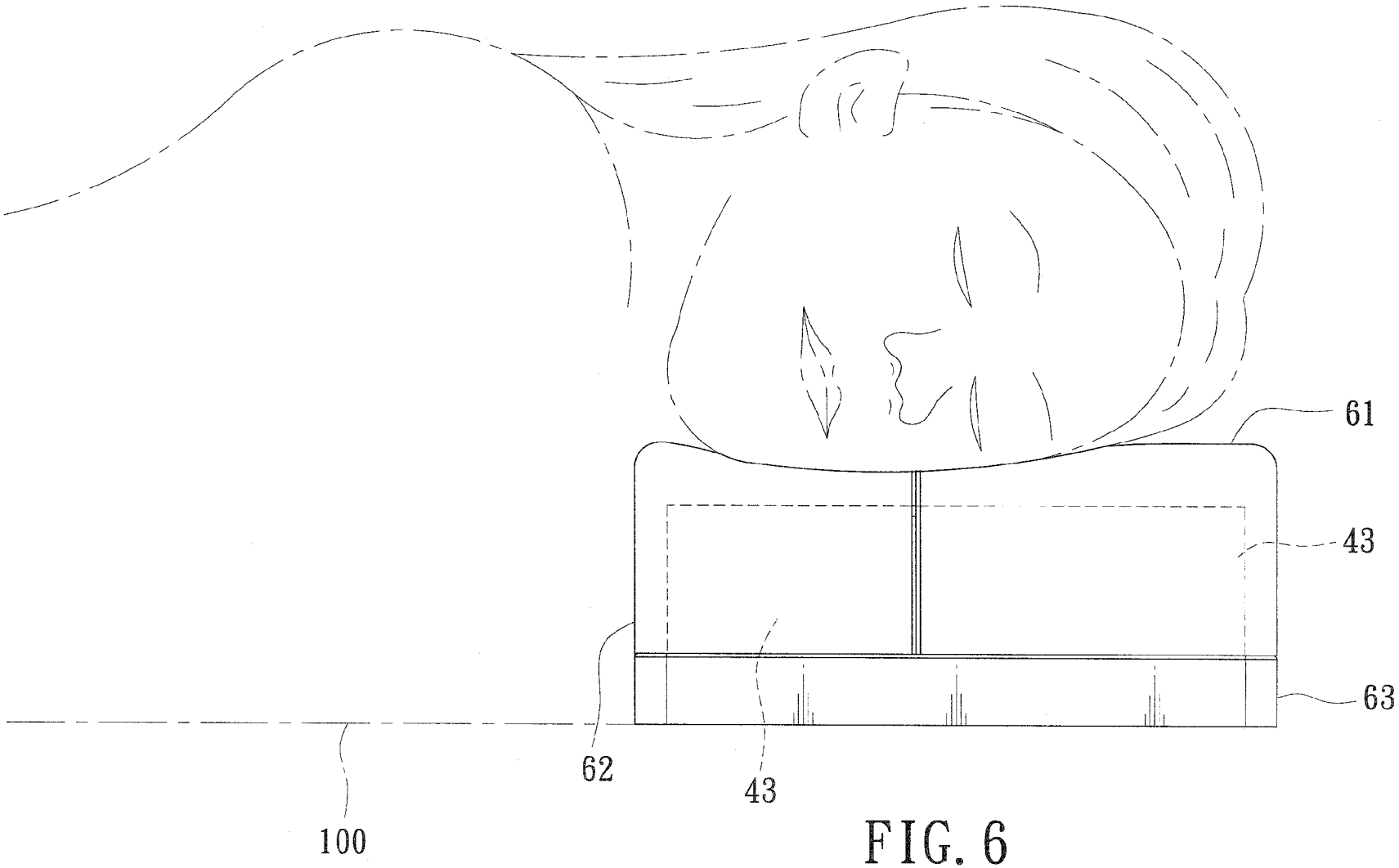
FIG. 6 is a schematic side view illustrating the preferred embodiment in a state of use.
Figure 7:
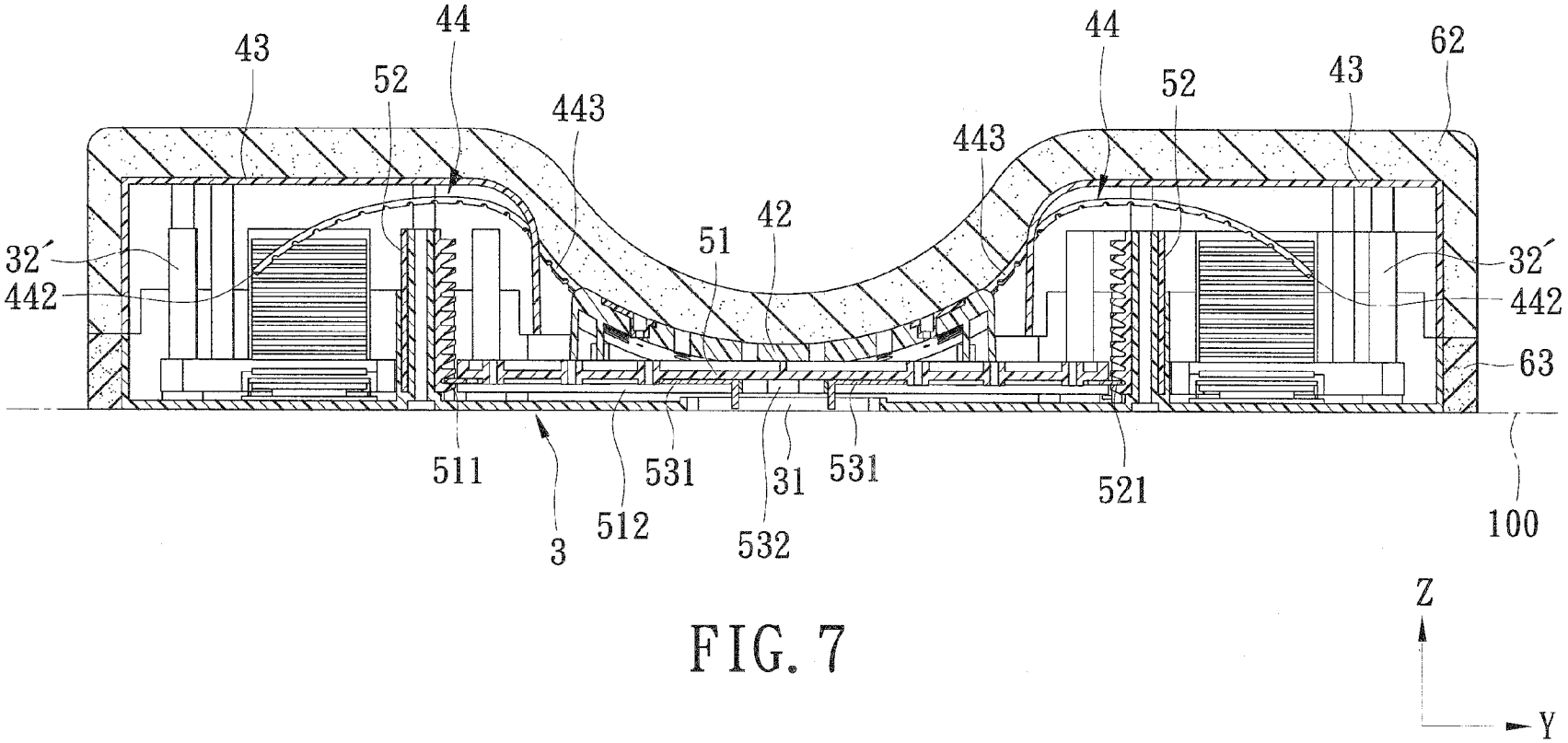
FIG. 7 is a schematic sectional view of the preferred embodiment taken along line VII-VII in FIG. 4.

The pillow unit 4 is disposed above the base 3 and is movable vertically relative to the base 3. In this embodiment, the pillow unit 4 includes rigid first and second pillow bodies 41, 42 aligned with each other in the first direction (X) and adapted for supporting respectively the head and neck of a human body thereon when the human body lies flat on the supporting surface 100, as shown in FIG. 5, and a pair of rigid third pillow bodies 43 opposite to each other in the second direction (Y) such that the first and second pillow bodies 41, 42 are disposed between the third pillow bodies 43. Each third pillow body 43 is adapted for supporting the head of the human body thereon when the human body lies on its side on the supporting surface 100, as shown in FIG. 6, and has a top surface higher than those of the first and second pillow bodies 41, 42, as shown in FIG. 3. It is noted that, in this embodiment, the third pillow bodies 43 are spaced apart from the second pillow body 42. The pillow unit 4 further includes a pair of resilient connecting members 44. Each connecting member 44 consists of a plurality of resilient ribs, has a connecting end 441 connected to a corresponding one of opposite sides of the second pillow body 42 in the second direction (Y), a free end 442 opposite to the connecting end 441 in the second direction (Y) and extending into a corresponding one of the third pillow bodies 43 through a plurality of through holes 431 therein, and a guiding portion 443 connected to the connecting end 441 and disposed between the second pillow body 42 and the corresponding one of the third pillow bodies 43 such that the second pillow body 42 cooperates with the guiding portions 443 of the connecting members 44 to constitute a concave structure interconnecting the third pillow bodies 43, as shown in FIGS. 3 and 7.

The supporting unit 5 is mounted on the base 3, is disposed between the base 3 and the pillow unit 4, and is operable so as to support the pillow unit 4 in a desired state. Preferably, the supporting unit 5 is operable to adjust each of the first, second and third pillow bodies 41, 42, 43 in the vertical direction (Z) so that each of the first, second and third pillow bodies 41, 42, 43 is supported by the supporting unit 5 at a desired height relative to the supporting surface 100 when the pillow unit 4 is in the desired state. In this case, a desired height difference is formed between the first and second pillow bodies 41, 42.

In this embodiment, the supporting unit 5 includes a pair of first supporting members 50 corresponding respectively to the first and second pillow bodies 41, 42, and a pair of second supporting members 50' corresponding respectively to the third pillow bodies 43.

Each first supporting member 50 is operable so as to support a corresponding one of the first and second pillow bodies 41, 42 at the desired height relative to the supporting surface 100, and includes a mounting plate 51, a pair of supporting seats 52 and a spring-loaded engaging unit 53. For each first supporting member 50, the mounting plate 51 is mounted on a bottom side of the corresponding one of the first and second pillow bodies 41, 42, and is formed with a plurality of through holes 511 permitting extension of the guiding rods 32 of a corresponding first guiding unit therethrough such that the mounting plate 51 is guided by the guiding rods 32 of the corresponding first guiding unit to move relative to the base 3 in the vertical direction (Z). The supporting seats 52 are opposite to each other in the second direction (Y), are mounted on the base 3, and flank the mounting plate 51. Each of the supporting seats 52 has a side surface facing the other one of the supporting seats 52 and formed with a plurality of engaging grooves 521. The spring-loaded engaging unit 53 is disposed under the mounting plate 51 and above a corresponding one of the first openings 31 in the base 3, and is operable to engage releasably the supporting seats 52 for supporting an assembly of the mounting plate 51 and the corresponding one of the first and second pillow bodies 41, 42 thereon such that the corresponding one of the first and second pillow bodies 41, 42 is positioned at the desired height relative to the supporting surface 100. In this embodiment, the spring-loaded engaging unit 53 is received in a receiving groove 512 in a bottom side of the mounting plate 51 (see FIG. 5), and includes two engaging pieces 531, and a spring piece 532 disposed between and abutting respectively against the engaging pieces 531 for biasing each of the engaging pieces 531 to engage a selected one of the engaging grooves 521 in a corresponding one of the supporting seats 52, as shown in FIG. 7.

Figure 9:
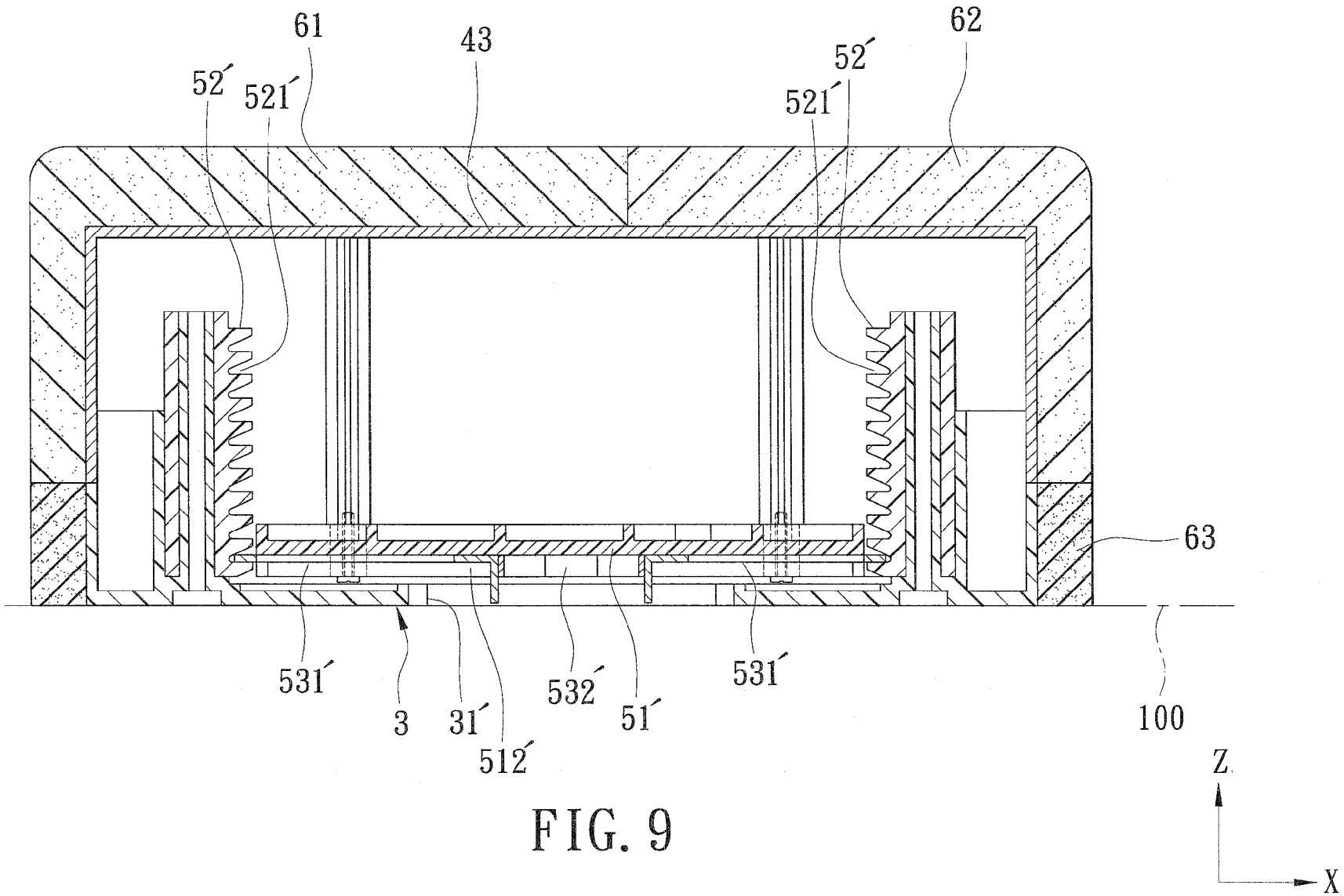
FIG. 9 is a schematic sectional view of the preferred embodiment taken along line IX-IX in FIG. 4.

Similar to the first supporting members 50, each second supporting member 50' is operable so as to support a corresponding one of the third pillow bodies 43 at the desired height relative to the supporting surface 100, and includes a mounting plate 51', a pair of supporting seats 52' and a spring-loaded engaging unit 53'. For each second supporting member 50', the mounting plate 51' is mounted on a bottom side of the corresponding one of the third pillow bodies 43, and is formed with a plurality of through holes 511' permitting extension of the guiding rods 32' of a corresponding second guiding unit therethrough such that the mounting plate 51' is guided by the guiding rods 32' of the corresponding second guiding unit to move relative to the base 3 in the vertical direction (Z). The supporting seats 52' are opposite to each other in the first direction (X), are mounted on the base 3, and flank the mounting plate 51'. Each of the supporting seats 52' has a side surface facing the other one of the supporting seats 52' and formed with a plurality of engaging grooves 521' The spring-loaded engaging unit 53' is disposed under the mounting plate 51' and above a corresponding one of the second openings 31' in the base 3, and is operable to engage releasably the supporting seats 52' for supporting an assembly of the mounting plate 51' and the corresponding one of the third pillow bodies 43 thereon such that the corresponding one of the third pillow bodies 43 is positioned at the desired height relative to the supporting surface 100. In this embodiment, the spring-loaded engaging unit 53' is received in a receiving groove 512' in a bottom side of the mounting plate 51' (see FIG. 9), and includes two engaging pieces 531', and a spring piece 532' disposed between and abutting respectively against the engaging pieces 531' for biasing each of the engaging pieces 531' to engage a selected one of the engaging grooves 521' in a corresponding one of the supporting seats 52', as shown in FIG. 9.

The cushioning cover 6 covers the pillow unit 4 and the base 3. In this embodiment, the cushioning cover 6 includes complementary first, second and third cover bodies 61, 62, 63, wherein the first and second cover bodies 61, 62 cover the pillow unit 4, and the third cover body 63 surrounds the base 3.

Figure 8:
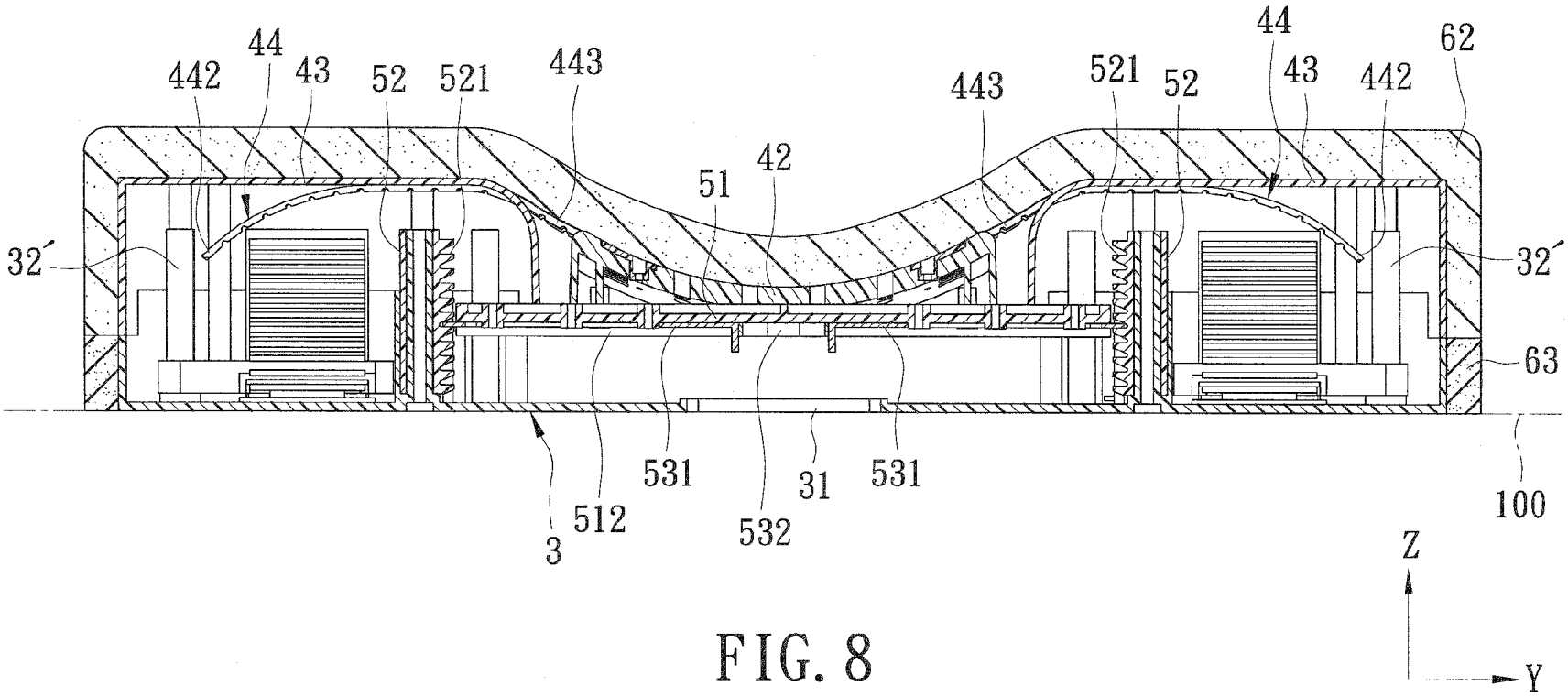
FIG. 8 is a schematic sectional view illustrating that a second pillow body of the preferred embodiment is adjusted to a higher position.
Figure 10:
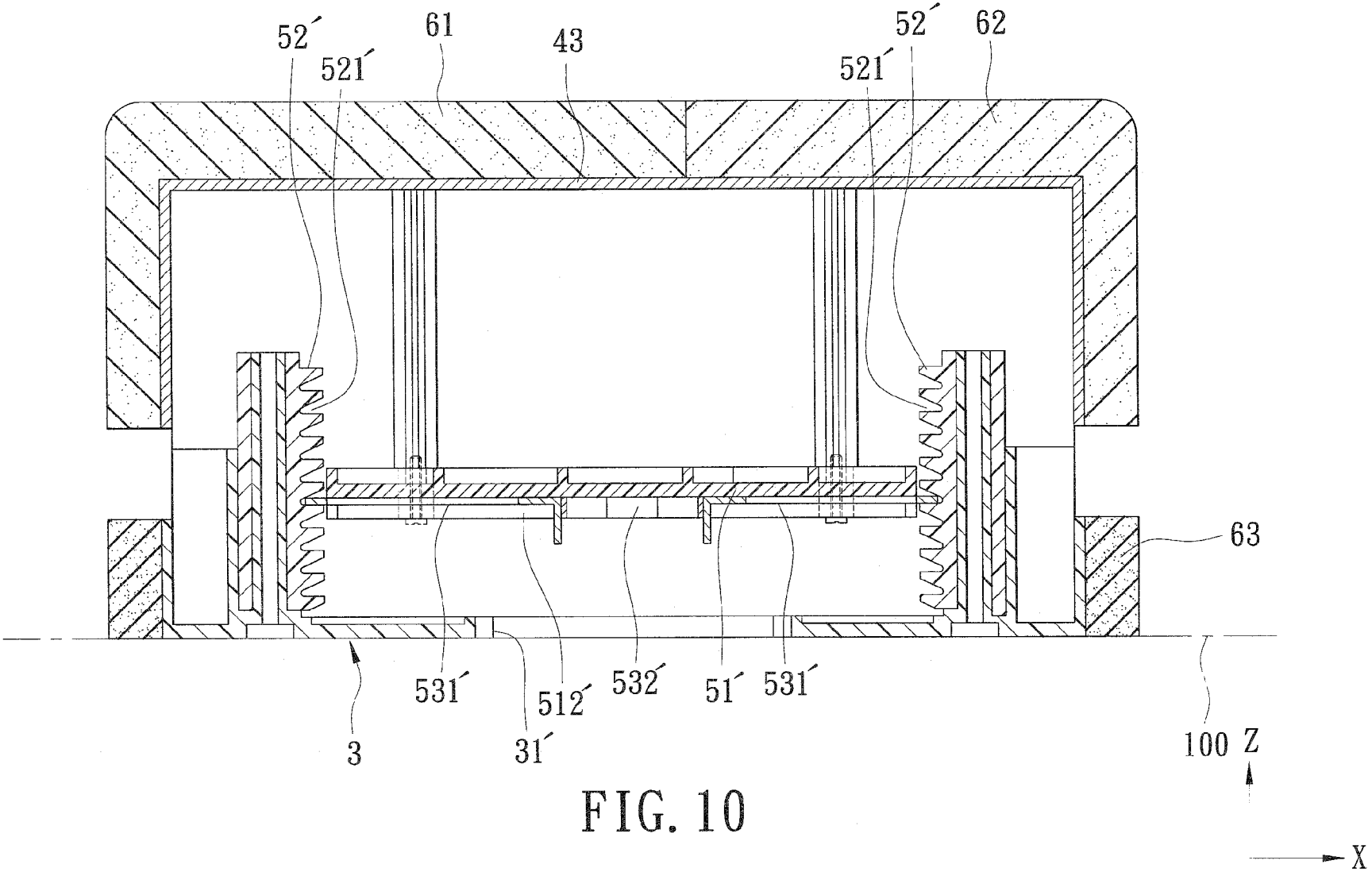
FIG. 10 is a schematic sectional view illustrating that a third pillow body of the preferred embodiment is adjusted to a higher position.

When each of the first, second and third pillow bodies 41, 42, 43 is adjusted from a current position to a desired position, firstly, the spring piece 532, 532' of the spring-loaded engaging unit 53, 53' of a corresponding one of the supporting members 50, 50' is compressed through operation of fingers of a user such that the engaging pieces 531, 531' of the spring-loaded engaging unit 53, 53' of the corresponding one of the supporting members 50, 50' disengage respectively the current engaging grooves 521, 521' in the supporting seats 52, 52' of the corresponding one of the supporting members 50, 50'. Simultaneously, the mounting plate 51, 51' of the corresponding one of the supporting members 50, 50' is moved in the vertical direction (Z) until a corresponding one of the first, second and third pillow bodies 41, 42, 43 reaches the desired position. Then, the spring piece 532, 532' of the spring-loaded engaging unit 53, 53' of the corresponding one of the supporting members 50, 50' is released such that the engaging pieces 531, 531' of the spring-loaded engaging unit 53, 53' of the corresponding one of the supporting members 50, 50' engage respectively the corresponding engaging grooves 521, 521' in the supporting seats 52, 52' of the corresponding one of the supporting members 50, 50'. FIG. 8 illustrates that the second pillow body 42 is adjusted to a higher position as compared to that in FIG. 7, and FIG. 10 illustrates that the third pillow body 43 is adjusted to a higher position as compared to that in FIG. 9.

The following are some of the advantages attributed to the adjustable pillow device of the present invention:

1. Due to the use of the rigid first, second and third pillow bodies 41, 42, 43 and the cushioning cover 6, adequate and comfortable support for the head and neck of a human body can be ensured during use.

2. Due to the presence of the adjustable supporting unit 5, each of the first, second and third pillow bodies 41, 42, 43 can be adjusted so as to be suitable for different requirements of users.

3. The spring-loaded engaging units 53, 53' are easily operated during adjustment of the pillow unit 4. Thus, the adjustable pillow device is convenient during use.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A pillow device comprising:

a base adapted to be disposed on a supporting surface;

a pillow unit disposed above said base and movable vertically relative to said base, said pillow unit including rigid first and second pillow bodies aligned with each other in a first direction and adapted for supporting respectively the head and neck of a human body thereon when the human body lies flat on the supporting surface; and an adjustable supporting unit mounted on said base, disposed between said base and said pillow unit, and operable so as to support said pillow unit in a desired state, said supporting unit being operable to vertically adjust at least one of said first and second pillow bodies so that a desired height difference is formed between said first and second pillow bodies when said pillow unit is in the desired state;

wherein said supporting unit includes at least one first supporting member operable to support a corresponding one of said first and second pillow bodies at a desired height relative to the supporting surface when said pillow unit is in the desired state; and wherein said first supporting member includes a pair of supporting seats opposite to each other in a second direction perpendicular to the first direction, mounted on said base, and flanking the corresponding one of said first and second pillow bodies, and an engaging unit disposed under the corresponding one of said first and second pillow bodies and operable to engage releasably said supporting seats for supporting the corresponding one of said first and second pillow bodies thereon such that the corresponding one of said first and second pillow bodies is positioned at the desired height relative to the supporting surface.

2. The pillow device as claimed in claim 1, wherein:

said base is formed with at least one first opening arranged so that said engaging unit of said first supporting member is disposed above said opening; and said first supporting member further includes a mounting plate mounted on a bottom side of the corresponding one of said first and second pillow bodies such that an assembly of said mounting plate and the corresponding one of said first and second pillow bodies is supported by said engaging unit.

3. The pillow device as claimed in claim 1, wherein:

each of said supporting seats of said first supporting member has a side surface facing the other one of said supporting seats of said first supporting member and formed with a plurality of engaging grooves; and said engaging unit of said first supporting member includes two engaging pieces, and a spring piece disposed between and abutting respectively against said engaging pieces for biasing each of said engaging pieces to engage a selected one of said engaging grooves in a corresponding one of said supporting seats of said first supporting member.

4. The pillow device as claimed in claim 2, wherein said base is further formed with at least one first guiding unit, said first guiding unit including a plurality of guiding rods extending vertically through said mounting plate of said first supporting member for guiding vertical movement of said mounting plate of said first supporting member relative to said base.

5. The pillow device as claimed in claim 1, wherein said pillow unit further includes a pair of rigid third pillow bodies opposite to each other in the second direction such that said first and second pillow bodies are disposed between said third pillow bodies, each of said third pillow bodies being adapted for supporting the head of the human body thereon when the human body lies on its side on the supporting surface, and having a top surface higher than those of said first and second pillow bodies.

6. The pillow device as claimed in claim 5, wherein:

said third pillow bodies are spaced apart from said second pillow body; and said pillow unit further includes a pair of resilient connecting members each having a connecting end connected to a corresponding one of opposite sides of said second pillow body in the second direction, a free end opposite to said connecting end in the second direction and extending into a corresponding one of said third pillow bodies, and a guiding portion connected to said connecting end and disposed between said second pillow body and the corresponding one of said third pillow bodies such that said second pillow body cooperates with said guiding portions of said connecting members to constitute a concave structure interconnecting said third pillow bodies.

7. The pillow device as claimed in claim 5, wherein said supporting unit further includes a pair of second supporting members corresponding respectively to said third pillow bodies, each of said second supporting members being operable so as to support a corresponding one of said third pillow bodies at a desired height when said pillow unit is in the desired state.

8. The pillow device as claimed in claim 7, wherein:

said base is further formed with two second openings corresponding respectively to said second supporting members; and each of said second supporting members includes a mounting plate mounted on a bottom side of the corresponding one of said third pillow bodies and movable vertically relative to said base, a pair of supporting seats opposite to each other in the first direction, mounted on said base, and flanking said mounting plate, and a spring-loaded engaging unit disposed under said mounting plate and above a corresponding one of said second openings in said base, and operable to engage releasably said supporting seats for supporting an assembly of said mounting plate and the corresponding one of said third pillow bodies thereon such that the corresponding one of said third pillow bodies is positioned at the desired height relative to the supporting surface.

9. The pillow device as claimed in claim 8, wherein:

each of said supporting seats of each of said second supporting members has a side surface facing the other one of said supporting seats of a corresponding one of said second supporting members and formed with a plurality of engaging grooves; and said spring-loaded engaging unit of each of said second supporting members includes two engaging pieces, and a spring piece disposed between and abutting respectively against said engaging pieces for biasing each of said engaging pieces to engage a selected one of said engaging grooves in a corresponding one of said supporting seats of the corresponding one of said second supporting members.

10. The pillow device as claimed in claim 8, wherein said base is further formed with two second guiding units, each of said second guiding units including a plurality of guiding rods extending vertically through said mounting plate of a corresponding one of said second supporting members for guiding vertical movement of said mounting plate of the corresponding one of said second supporting members relative to said base.

11. The pillow device as claimed in claim 1, further comprising a cushioning cover for covering said pillow unit and said base.

* * * * *